US009813828B2

(12) United States Patent
Keller et al.

(10) Patent No.: US 9,813,828 B2
(45) Date of Patent: Nov. 7, 2017

(54) SPEAKER SYSTEM WITH ACOUSTIC EVENT DETECTION, MODIFICATION KIT FOR SPEAKER SYSTEM AND METHOD OF MODIFYING A SPEAKER SYSTEM

(71) Applicant: EATON CORPORATION, Cleveland, OH (US)

(72) Inventors: Joseph Rudy Keller, Eatontown, NJ (US); Scott Case, Highlands, NJ (US)

(73) Assignee: Eaton Corporation, Cleveland, OH (US)

( * ) Notice: Subject to any disclaimer, the term of this patent is extended or adjusted under 35 U.S.C. 154(b) by 53 days.

(21) Appl. No.: 14/725,006

(22) Filed: May 29, 2015

(65) Prior Publication Data

US 2016/0353219 A1 Dec. 1, 2016

(51) Int. Cl.
*H04R 29/00* (2006.01)
*H04R 27/00* (2006.01)

(52) U.S. Cl.
CPC ..... *H04R 27/00* (2013.01); *H04R 29/00* (2013.01); *H04R 2400/01* (2013.01)

(58) Field of Classification Search
CPC ..... H04R 29/001
See application file for complete search history.

(56) References Cited

U.S. PATENT DOCUMENTS

| | | | | |
|---|---|---|---|---|
| 7,688,679 | B2 | 3/2010 | Baxter et al. | |
| 7,710,278 | B2 | 5/2010 | Holmes et al. | |
| 7,719,428 | B2 | 5/2010 | Fisher et al. | |
| 7,961,550 | B2 | 6/2011 | Calhoun | |
| 2014/0190051 | A1* | 7/2014 | Wichner | F41A 17/12 42/1.05 |
| 2014/0327543 | A1* | 11/2014 | Showen | G08B 17/08 340/540 |
| 2014/0341400 | A1* | 11/2014 | Powell | H04R 3/12 381/150 |

* cited by examiner

*Primary Examiner* — Regina N Holder
(74) *Attorney, Agent, or Firm* — Eckert Seamans; Nathaniel Wilks; Grant Coffield

(57) ABSTRACT

A speaker system with acoustic event detection, the speaker system including a number of speakers, a head unit including an output circuit structured to output an output signal to the speakers to cause the speakers to output an audible sound, and an acoustic event detection module structured to receive signals from the speakers and to detect an acoustic event based on the signals received from the speakers.

19 Claims, 3 Drawing Sheets

SPEAKER SYSTEM WITH ACOUSTIC EVENT DETECTION, MODIFICATION KIT FOR SPEAKER SYSTEM AND METHOD OF MODIFYING A SPEAKER SYSTEM

BACKGROUND

Field

The disclosed concept relates generally to acoustic event detection such as gunshot detection, and, more particularly, to speaker systems with acoustic event detection capability. The disclosed concept also relates to modification kits for speaker systems and methods of modifying speaker systems.

Background Information

Gunshot detection systems typically include a number of sound sensors, such as microphones, to detect the sound of a gunshot. The systems process the sounds received by the sound sensors to distinguish a gunshot from other sounds. Such systems may also determine the location of the gunshot. Example gunshot detection systems are disclosed in U.S. Pat. Nos. 7,961,550, 7,710,278, 7,719,428 and 7,688,679.

Gunshot detection systems can be employed in a variety of places such as buildings, urban areas, college or university campuses, etc. However, the cost of the gunshot detection system can be prohibitive. Among other costly factors is the requirement for known systems is installing and wiring geographically spaced sound sensors.

Many areas have speaker systems, such as alarm systems (e.g., without limitation, fire alarm systems) or mass notification systems, already installed and wired. FIG. 1 is a schematic diagram of a speaker system 1. The speaker system 1 of FIG. 1 includes a head unit 2 and a number of speakers 4 electrically connected in parallel to the head unit 2. An end-of-line resistor 6 is also electrically connected in parallel with the speakers 4.

The head unit 2 includes an alarm output circuit 7 and a supervision circuit 8. The output circuit 7 is structured to selectively output an alternating current signal such as an alarm signal which causes the speakers 4 to audibly output an alarm. Otherwise, when the output circuit 7 is not outputting the output signal, the speakers 4 remain silent. The supervision circuit 8 outputs a supervision signal that verifies that the end-of-line resistor 6 is in place and verifies the integrity of the wiring of the speakers 4. The supervision circuit 8 may output a direct current signal or an alternating current signal to verify the integrity of the wiring.

Speaker systems have not traditionally been used for purposes other than sounding alarm signals.

It would be beneficial to reduce the cost of a gunshot detection system.

SUMMARY

These needs and others are met by embodiments of the disclosed concept, which are directed to a speaker system including an acoustic event detection module. These needs and others are also met by embodiments of the disclosed concept, which are directed to a modification kit which can be used with an existing speaker system and a method of modifying an existing speaker system.

In accordance with one aspect of the disclosed concept, a speaker system with acoustic event detection comprises: a number of speakers; a head unit including an output circuit structured to output an output signal to the speakers to cause the speakers to output an audible sound; and an acoustic event detection module structured to receive signals from the speakers and to detect an acoustic event based on the signals received from the speakers.

In accordance with another aspect of the disclosed concept, an acoustic event detection modification kit for a speaker system including a number of speakers comprises: an acoustic event detection module structured to receive signals from the speakers and to detect an acoustic event based on the signals received from the speakers.

In accordance with another aspect of the disclosed concept, a method of modifying a speaker system including a number of speakers to include acoustic event detection comprises: providing an acoustic event detection module structured to receive signals from the speakers and to detect an acoustic event based on the signals received from the speakers; and electrically connecting the acoustic event detection module to the speakers.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
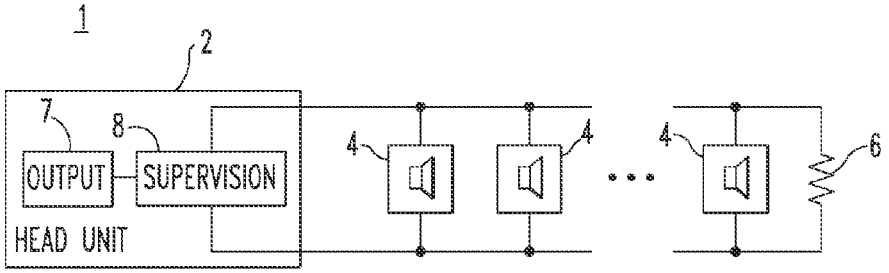
FIG.1 (PRIOR ART)
FIG. 1 is a schematic diagram of a prior art speaker system.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

As employed herein, the term "processor" shall mean a programmable or fixed analog and/or digital device that can store, retrieve, and process data (e.g., without limitation, a computer; a workstation; a personal computer; a controller; a digital signal processor; a microprocessor; a microcontroller; a microcomputer; a central processing unit; a mainframe computer; a mini-computer; a server; a networked processor; a programmable logic controller; or any suitable processing device or apparatus).

As employed herein, the term "electrical supervision" shall mean applying an electrical signal to a wiring system to verify the integrity of the wiring system.

Figure 2:
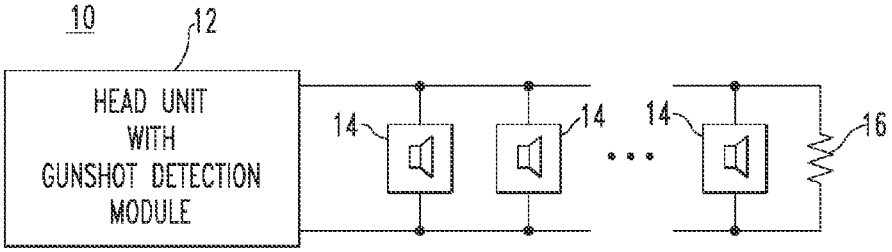
FIG. 2 is a schematic diagram of a speaker system with a gunshot detection module in accordance with an exemplary embodiment of the disclosed concept.

FIG. 2 is a schematic diagram of a speaker system that includes a head unit 12 that provides a gunshot detection capability in accordance with an exemplary embodiment of the disclosed concept. The speaker system 10 includes the head unit 12, a number of speakers 14 and an end-of-line resistor 16.

The speakers 14 and the end-of-line resistor 16 are electrically connected in parallel with the head unit 12. The speakers 14 may be geographically spaced and located at various locations within the area covered by the speaker system 10. The area covered by the speaker system 10 may be any geographic area such as, without limitation, a section of a city, a neighborhood, a building, or any other suitable area.

In several example embodiments of the disclosed concept, it is anticipated that the speaker system 10 will be created by modifying an existing speaker system such as the speaker system 1 of FIG. 1. For example, the speakers 4 and end-of-line resistor 6 of FIG. 1 may be employed as the speakers 14 and end-of-line resistor 16 in the speaker system 10 of FIG. 2. The head unit 2 of FIG. 1, which does not provide a gunshot detection capability, may be replaced by the head unit 12 of FIG. 2, which does provide a gunshot detection capability. Since the speakers 14 are already installed and wired, the cost of the speaker system 10 with the gunshot detection capability is considerably reduced compared with installing and wiring an entire system from scratch.

The speaker system 10 provides the gunshot detection capability, in part, by using the speakers 14 not only as speakers, but also as sounds sensors. Applying an alternating current signal to the speakers 14 causes the speakers 14 to audibly output the signal. However, when an audible sound is applied to the speakers 14, the speakers 14 will output an alternating current signal in response to receiving the audible sound. Traditional speaker systems, such as the speaker system 1 of FIG. 1, are not concerned with signals from its speakers 4, and thus have no mechanism to receive and process the signals. In contrast, the head unit 12 of the speaker system 10 of FIG. 2 includes circuitry and components structured to receive and process signals from the speakers 14 in order to provide a gunshot detection capability. The head unit 12 will be described in more detail hereinafter with respect to FIG. 3.

Figure 3:
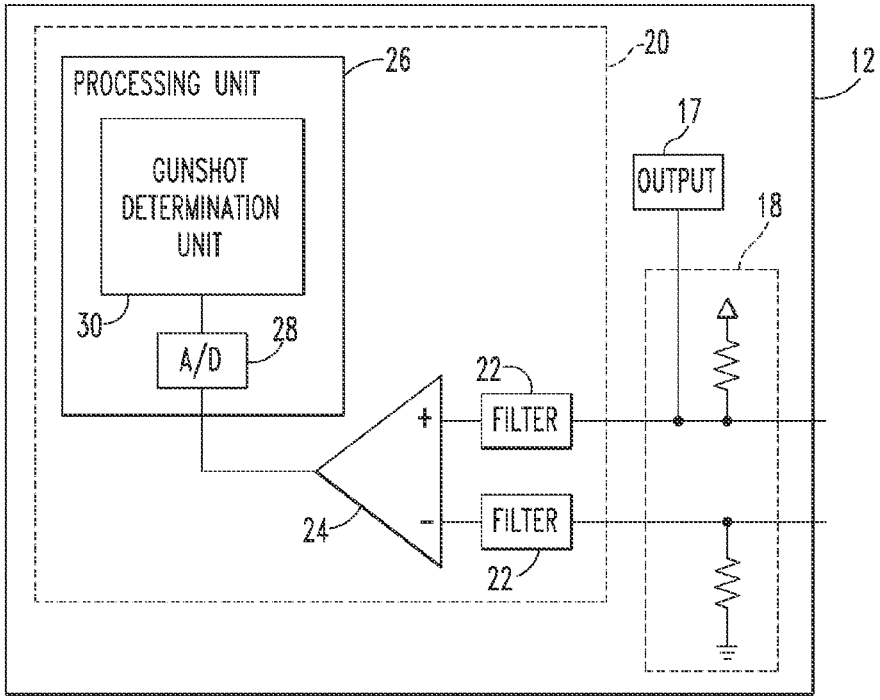
FIG. 3 is a schematic diagram of a head unit with a gunshot detection module in accordance with an exemplary embodiment of the disclosed concept.

FIG. 3 is a schematic diagram of the head unit 12 of the speaker system 10 of FIG. 2. The head unit 12 includes an output circuit 17 and a supervision circuit 18. The output circuit 17 is structured to selectively output an alternating current output signal which is audibly output by the speakers 14. The supervision circuit 18 provides electrical supervision to verify the integrity of the wiring of the speakers 14 and end-of-line resistor 16. While a direct current supervision circuit 18 is illustrated in FIG. 3, it is contemplated that any suitable supervision circuit such as, without limitation, an alternating current supervision circuit, may be employed without departing from the scope of the disclosed concept. The output circuit 17 and the supervision circuit 18 operate similar to the output circuit 7 and the supervision circuit 8 of FIG. 1.

The head unit 12 further includes a gunshot detection module 20. The gunshot detection module 20 is electrically connected such that the supervision circuit 18 is electrically connected between the gunshot detection module 20 and the speakers 14. The gunshot detection module 20 includes filters 22, a comparator 24 (may also be referred to as an amplifier or an op-amp) and a processing unit 26.

The filters 22 are electrically connected between the supervision circuit 18 and the comparator 24. The filters 22 are structured to filter the electrical supervision signal that the supervision circuit 18 outputs. An alternating current signal output by the speakers 14 as a result of them detecting audible sounds will be passed through the filters 22 to the comparator 24. The filters 22 may be constructed of any suitable device or devices for filtering direct current signals such as, without limitation, capacitors.

The comparator 24 is electrically connected between the filters 22 and the processing unit 26. The comparator 24 is structured to compare differences between voltages between positive and negative connections of the speakers 14 and to output a signal representing the difference to the processing unit 26. The signal from the comparator 24 to the processing unit 26 is representative of audible sounds received by the speakers 14. It is contemplated that in some example embodiments of the disclosed concept, the comparator 24 may be omitted or integrated into the processing unit 26.

The processing unit 26 includes an analog to digital converter 28 and a gunshot determination unit 30. The analog to digital converter 28 is structured to receive the signal output from the comparator 24 and to convert it into a digital signal. The gunshot determination unit 30 is structured to analyze the digital signal and to determine whether it is indicative of a gunshot. The digital signal is representative of the signals output by the speakers 14, which are in turn representative of the sounds detected by the speakers 14. The gunshot determination unit 30 unit may use any suitable and/or known algorithm to make a determination of whether a gunshot has been detected.

It is contemplated that the processing unit 26 may include a processor (not shown) or an analog filter network (not shown). The processor may be, for example and without limitation, a microprocessor, a microcontroller, or some other suitable processing device or circuitry. It is also contemplated that the processing unit 26 may include a memory (not shown). The memory may be any of one or more of a variety of types of internal and/or external storage media such as, without limitation, RAM, ROM, EPROM(s), EEPROM(s), FLASH, and the like that provide a storage register, i.e., a machine readable medium, for data storage such as in the fashion of an internal storage area of a computer, and can be volatile memory or nonvolatile memory. It is contemplated that the processor and/or memory may be employed to implement one or more operations of the processing unit 26 such as analog to digital conversion or gunshot detection. It is further contemplated that in some example embodiments of the disclosed concept, the analog to digital converter 28 may be omitted or located outside of the processing unit 26.

In some example embodiments of the disclosed concept, the speaker system 10 is an alarm system such as, without limitation, a fire alarm system. In such embodiments, the output circuit 17 is an alarm output circuit structured to output an alarm output signal which causes the speakers 14 to output an audible alarm. In some other example embodiments of the disclosed concept, the speaker system 10 is a public announcement system such as, without limitation, a mass notification system. In such embodiments, the output circuit 17 is an announcement output circuit structured to output an announcement output signal which causes the speakers 14 to output an audible announcement.

Figures 4, 5, 6:
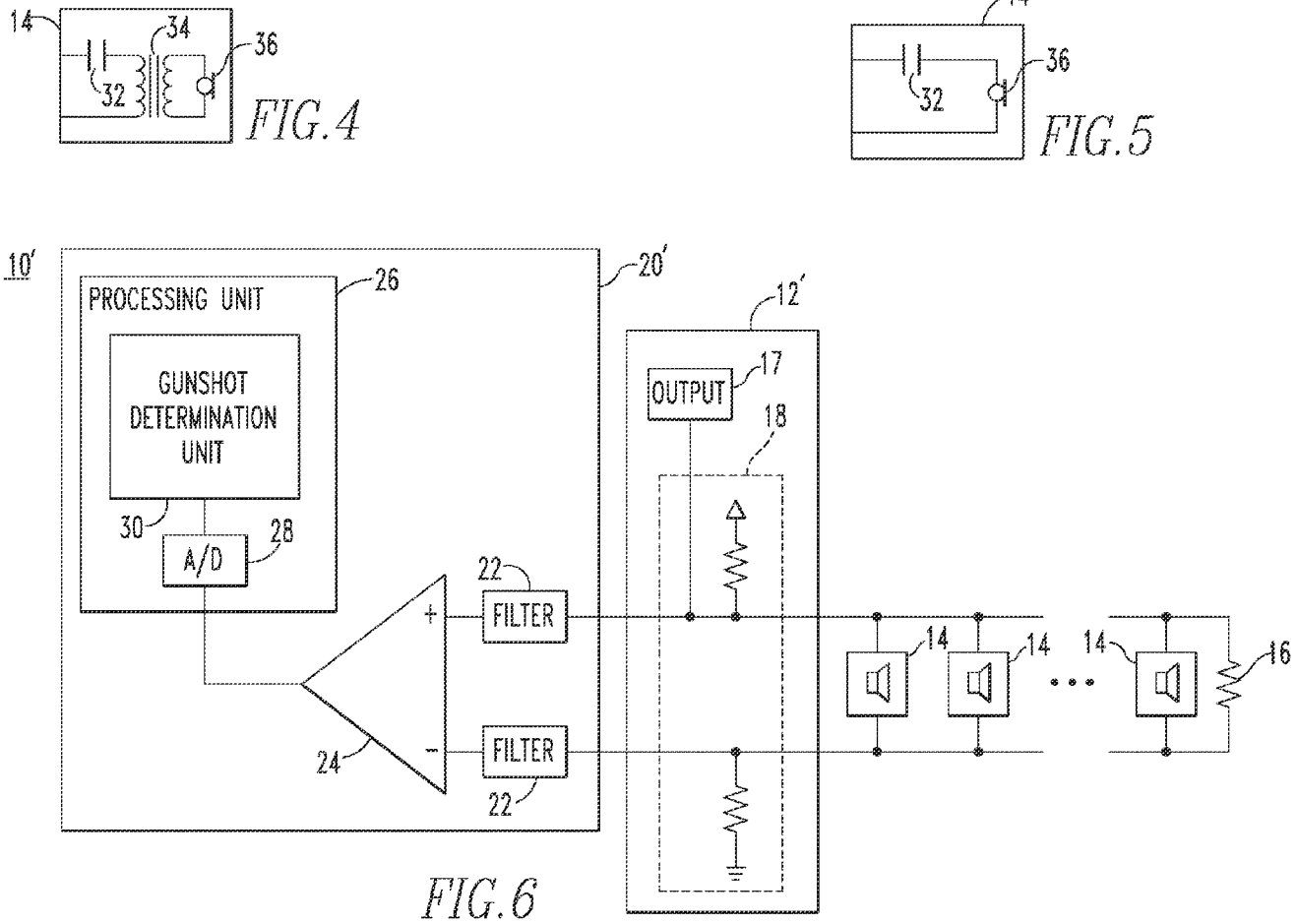
FIGS. 4 and 5 are schematic diagrams of speakers in accordance with exemplary embodiments of the disclosed concept.
FIGS. 6 and 7 are schematic diagrams of speaker systems with a gunshot detection module in accordance with other exemplary embodiments of the disclosed concept.

FIG. 4 is a schematic diagram of one of the speakers 14 of the speaker system 10 of FIG. 2. The speaker 14 includes a capacitor 32, a transformer 34 and a speaker element 36. The capacitor 32 is electrically connected between the positive input of the speaker 14 and the transformer 34. The capacitor 32 appears as an open circuit to a direct current signal, such as the direct current signal applied by the direct current supervision system 18.

The transformer 34 is electrically connected between the capacitor 32 and the speaker element 36. The transformer 34 is structured to electrically step up or step down an alternating current signal received by the speaker 14 so that it is suitable for audible output by the speaker element 36.

The speaker element 36 is structured to audibly output an alternating current signal. The speaker element 36 is also configured output an alternating current signal in response to receiving audible sounds. Any suitable type of speaker element that is capable of outputting an alternating current signal as audible sound and also outputting an alternating current signal in response to receiving audible sounds may be employed as the speaker element 36. The speaker element 36 does not necessarily need to have the capability of detecting audible sounds with the accuracy of a microphone specifically designed for that purpose. A gunshot typically has an acoustic level between 120-160 dB, which is relatively high. As such, speaker elements 36, even though not specially designed to accurately detect sounds, are sufficient for detecting gunshots.

It is contemplated that in some example embodiments of the disclosed concept, the speaker 4 from the speaker system 1 of FIG. 1 may be employed as the speaker 14 of FIG. 4.

FIG. 5 is a schematic diagram of another type of speaker 14 that may be employed in the speaker system 10 of FIG. 2. The speaker 14' of FIG. 5 is similar to the speaker 14 of FIG. 4. However, the transformer 34 is omitted from the speaker 14' of FIG. 5.

Figure 7:
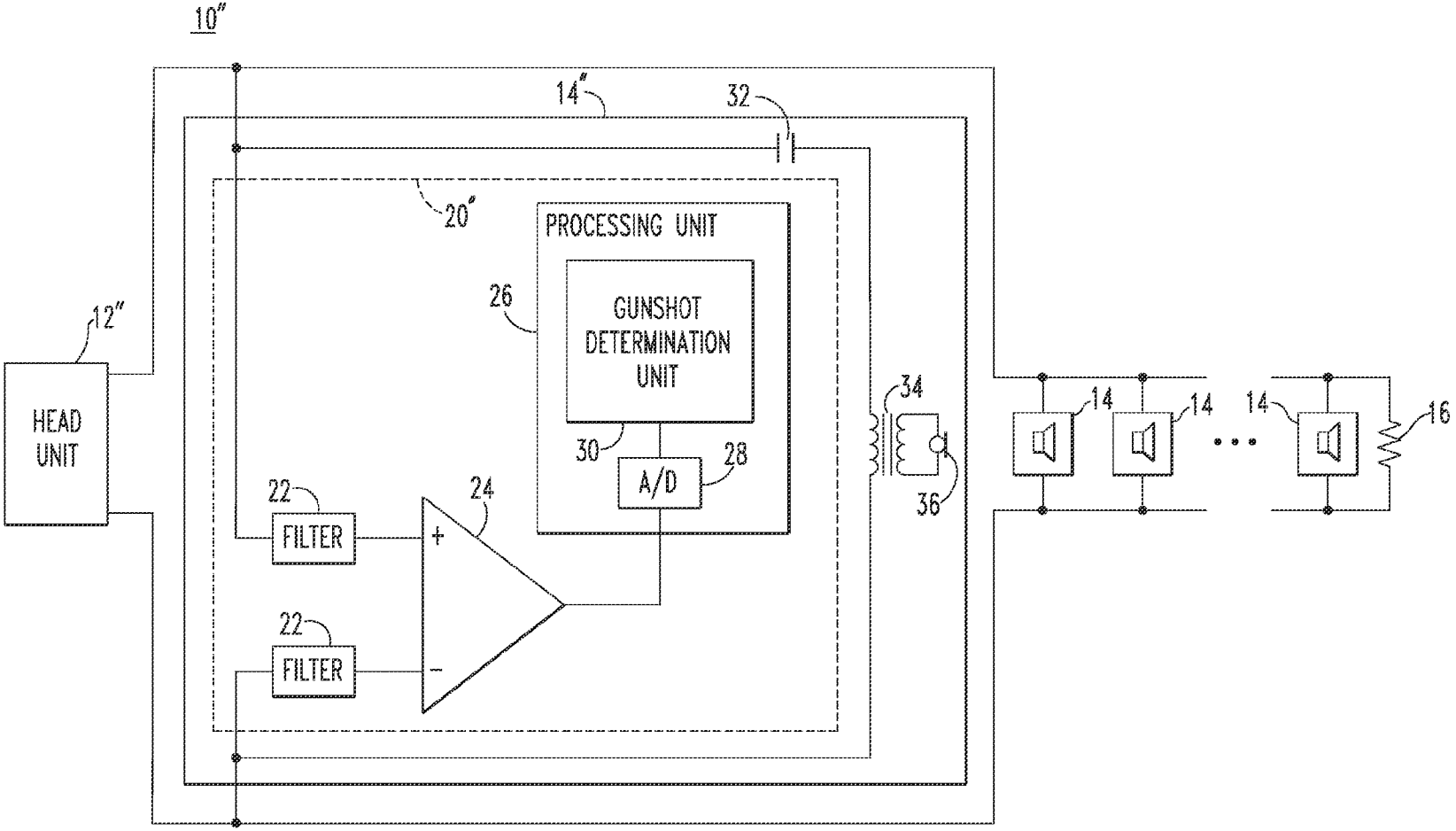

FIGS. 6 and 7 are schematic diagrams of speaker systems in accordance with other exemplary embodiments of the disclosed concept. The speaker system 10' of FIG. 6 is similar to the speaker system 10 of FIG. 2. However, in the speaker system 10' of FIG. 6, includes a gunshot detection module 20' that is separate from the head unit 12' and speakers 14. It is contemplated that the gunshot detection module 20' may be a stand-alone component or integrated into another piece of equipment.

The speaker system 10" of FIG. 7 is similar to the speaker system 10 of FIG. 2. However, in the speaker system 10" of FIG. 7, the gunshot detection module 20" is disposed in one of the speakers 14".

It is contemplated that the gunshot detection modules 20,20',20" may be employed as a modification kit for an existing speaker system. For example, referring back to FIG. 3, it is contemplated that the head unit 12 with the gunshot detection module 20 may be considered a modification kit for an existing speaker system, such as the speaker system 1 of FIG. 1. The head unit 2 of the speaker system 1 of FIG. 1 may be disconnected from the speakers 4. The head unit 12 of FIG. 3 may then be connected to the speakers 4. Such a modification will provide the speaker system 1 of FIG. 1 with a gunshot detection capability without the need to modify the speakers 4 or end-of-line resistor 6.

It is further contemplated that the gunshot detection module 20 may be considered a modification kit for an existing alarm system, such as the alarm system 1 of FIG. 1. The gunshot detection module 20 may be installed in the head unit 2 of the alarm system 1 of FIG. 1. Such a modification will provide the alarm system 1 of FIG. 1 with a gunshot detection capability.

Similarly, referring to FIG. 6, the gunshot detection module 20' may be connected to the head unit 2 of the speaker system 1 of FIG. 1 to provide the speaker system 1 of FIG. 1 with a gunshot detection capability without the need to modify the head unit 2, speakers 4 or end-of-line resistor 6.

Referring to FIG. 7, the speaker 14" including the gunshot detection module 20" may replace one of the speakers 14 of the speaker system 1 of FIG. 1 to provide the speaker system 1 of FIG. 1 with a gunshot detection capability without the need to modify the head unit 2, remaining speakers 4 or end-of-line resistor 6.

In some example embodiments of the disclosed concept, the speaker system 10 and the head unit 12 are not limited to detecting gunshots, but rather may detect a range of acoustic events such as, without limitation, explosions or types of weapon fire other than gunshots. It is contemplated that in some example embodiments of the disclosed concept, the gunshot detection modules 20,20',20" and gunshot determination unit 30 may be modified or replaced with an acoustic event detection module and acoustic event determination unit capable of detecting a broader range or a different range of acoustic events than gunshots.

While specific embodiments of the disclosed concept have been described detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A speaker system with acoustic event detection, the speaker system comprising:

a number of speakers;

a head unit including an output circuit structured to output an output signal to the speakers to cause the speakers to output an audible sound; and an acoustic event detection module structured to receive signals from the speakers and to detect an acoustic event based on the signals received from the speakers, wherein the head unit further includes a supervision circuit structured to provide electrical supervision to the speakers, wherein the acoustic event detection module includes a processing unit structured to analyze the signals received from the speakers and to determine whether the signals indicate the acoustic event, and wherein the acoustic event detection module includes one or more filters electrically connected between the supervision circuit and the processing unit and being structured to filter out the electrical supervision and to allow the signals received from the speakers to pass through.

2. The speaker system of claim 1, wherein the acoustic event detection module is disposed in the head unit.

3. The speaker system of claim 1, wherein the acoustic event detection module is disposed in one of the speakers.

4. The speaker system of claim 1, wherein the output circuit is an alarm output circuit and the output signal is an alarm output signal which causes the speakers to output an audible alarm.

5. The speaker system of claim 1, wherein the acoustic event is a gunshot.

6. The speaker system of claim 1, wherein the electrical supervision is direct current supervision.

7. The speaker system of claim 1, wherein the acoustic event detection module includes an analog to digital converter structured to convert the signals received from the speakers to digital signals.

8. The speaker system of claim 1, wherein the speakers each include a capacitor electrically connected in series with a transformer or a capacitor electrically connected in series with a speaker element.

9. The speaker system of claim 1, wherein the speakers each include a speaker element structured to detect sounds and output signals representing the detected sounds to the acoustic event detection module.

10. The speaker system of claim 1, wherein the speakers are electrically connected in parallel with each other.

11. The speaker system of claim 1, further comprising:

an end-of-line resistor electrically connected in parallel with the speakers.

12. An acoustic event detection modification kit for a speaker system including a number of speakers, the acoustic event detection modification system comprising:

an acoustic event detection module structured to receive signals from the speakers and to detect an acoustic event based on the signals received from the speakers; and a head unit including an output circuit structured to output an output signal to the speakers to cause the speakers to output an audible sound, wherein the head unit further includes a supervision circuit structured to provide electrical supervision to the speakers, wherein the acoustic event detection module includes a processing unit structured to analyze the signals received from the speakers and to determine whether the signals indicate the acoustic event, and wherein the acoustic event detection module includes one or more filters electrically connected between the supervision circuit and the processing unit and being structured to filter out the electrical supervision and to allow the signals received from the speakers to pass through.

13. The acoustic event detection modification kit of claim 12, wherein the acoustic event detection module is disposed in the head unit.

14. The acoustic event detection modification kit of claim 12, further comprising:

a modified speaker structured to be installed in addition to or replace one of the speakers of the speaker system, wherein the acoustic event detection module is disposed in the modified speaker.

15. The acoustic event detection modification kit of claim 12, wherein the acoustic event is a gunshot.

16. A method of modifying a speaker system including a number of speakers to include acoustic event detection, the method comprising:

providing an acoustic event detection module structured to receive signals from the speakers and to detect an acoustic event based on the signals received from the speakers;

providing a modified head unit including an output circuit structured to output an output signal to the speakers to cause the speakers to output an audible sound; and electrically connecting the acoustic event detection module and the output circuit to the speakers, wherein the modified head unit further includes a supervision circuit structured to provide electrical supervision to the speakers, wherein the acoustic event detection module includes a processing unit structured to analyze the signals received from the speakers and to determine whether the signals indicate the acoustic event, and wherein the acoustic event detection module includes one or more filters electrically connected between the supervision circuit and the processing unit and being structured to filter out the electrical supervision and to allow the signals received from the speakers to pass through.

17. The method of claim 16, further comprising:

disconnecting a current head unit of the speaker system from the speakers.

18. The method of claim 16, further comprising:

providing a modified speaker including the acoustic event detection module; and electrically connecting the modified speaker to the speakers or replacing one of the speakers with the modified speaker.

19. The method of claim 16, wherein the acoustic event is a gunshot.

* * * * *